US009258874B2

(12) United States Patent
Camara

(10) Patent No.: US 9,258,874 B2
(45) Date of Patent: Feb. 9, 2016

(54) X-RAY GENERATOR DEVICE

(71) Applicant: TRIBOGENICS, INC., Los Angeles, CA (US)

(72) Inventor: Carlos Camara, Los Angeles, CA (US)

(73) Assignee: Tribogenics, Inc., Los Angeles, CA (US)

( * ) Notice: Subject to any disclaimer, the term of this patent is extended or adjusted under 35 U.S.C. 154(b) by 0 days.

(21) Appl. No.: 14/574,131

(22) Filed: Dec. 17, 2014

(65) Prior Publication Data

US 2015/0124933 A1 May 7, 2015

Related U.S. Application Data

(63) Continuation of application No. 13/431,473, filed on Mar. 27, 2012, now Pat. No. 8,938,048.

(51) Int. Cl.
*H05G 2/00* (2006.01)

(52) U.S. Cl.
CPC ..... *H05G 2/00* (2013.01)

(58) Field of Classification Search
CPC ..... H01J 35/02; H01J 35/16; H05G 2/00
See application file for complete search history.

(56) References Cited

U.S. PATENT DOCUMENTS

| | | | | |
|---|---|---|---|---|
| 2,810,077 | A | 10/1957 | Gale | |
| 3,612,918 | A | 10/1971 | Willutzki | |
| 4,789,802 | A | 12/1988 | Miyake | |
| 4,990,813 | A | 2/1991 | Paramo | |
| 5,665,969 | A | 9/1997 | Beusch | |
| 6,476,406 | B1 | 11/2002 | Struye et al. | |
| 6,493,423 | B1 | 12/2002 | Bisschops | |
| 6,668,039 | B2 | 12/2003 | Shepard et al. | |
| 6,925,151 | B2 | 8/2005 | Harding et al. | |
| 7,060,371 | B2 | 6/2006 | Akiyama et al. | |
| 7,596,242 | B2 | 9/2009 | Breed et al. | |
| 9,089,038 | B2 * | 7/2015 | Camara | H05G 2/00 |
| 2005/0084073 | A1 | 4/2005 | Seppi et al. | |
| 2006/0188069 | A1 | 8/2006 | Anno et al. | |
| 2009/0050847 | A1 | 2/2009 | Xu et al. | |
| 2010/0290593 | A1 | 11/2010 | Legagneux et al. | |

(Continued)

FOREIGN PATENT DOCUMENTS

| | | | |
|---|---|---|---|
| CH | 308595 | A | 7/1955 |
| EP | 1870487 | A1 | 12/2007 |
| JP | 2009-283169 | A | 12/2009 |

OTHER PUBLICATIONS

Klyuev et al., "The effect of air pressure on the parameters of x-ray emission accompanying adhesive and cohesive breaking solids", Sov. Phys. Tech. Phys., vol. 34, Mar. 1989, pp. 361-364.

(Continued)

*Primary Examiner* — Glen Kao
(74) *Attorney, Agent, or Firm* — Klein, O'Neill & Singh, LLP

(57) ABSTRACT

An x-ray generator device includes a housing at least partially holding a specific fluid pressure, with an arm positioned to be able to strike a strike plate within the housing. The housing contains an x-ray window. The arm is magnetically actuated in at least one direction by a magnetic field generator outside of the housing. A striking portion of the lever arm and/or the strike plate may be a polymeric material with embedded metal or metal alloys.

9 Claims, 7 Drawing Sheets

(56) References Cited

U.S. PATENT DOCUMENTS

| | | | |
|---|---|---|---|
| 2011/0130613 | A1 | 6/2011 | Putterman et al. |
| 2012/0051496 | A1 | 3/2012 | Wang et al. |
| 2013/0336460 | A1 | 12/2013 | Camara et al. |
| 2013/0343526 | A1 | 12/2013 | Putterman et al. |
| 2014/0044235 | A1 | 2/2014 | Camara et al. |
| 2014/0126692 | A1 | 5/2014 | Camara |

OTHER PUBLICATIONS

Nakayama et al., "Triboemission of charged particles and photons from solid surfaces during frictional damage", Journal of Physics D. Applied Physics, vol. 25, No. 2, Feb. 14, 1992, pp. 303-308.

Nishitani et al., "STM tip-enhanced photoluminescence from porphyrin film", Surface Science, North-Holland Publishing Co., vol. 601, No. 17, Aug. 23, 2007, pp. 3601-3604.

Ohara et al., "Light emission due to peeling of polymer films from various substrates", Journal of Applied Polymer Science, vol. 14, No. 8, Aug. 1, 1970, pp. 2079-2095.

International Search Report on related PCT Application No. PCT/US2013/033536 from International Searching Authority (KIPO) dated Jul. 8, 2013.

Written Opinion on related PCT Application No. PCT/US2013/033536 from International Searching Authority (KIPO) dated Jul. 8, 2013.

U.S. Appl. No. 13/431,473, filed Mar. 27, 2012, Carlos Camara, Pub. No. US 2013-0259204 A1, Office Action, Feb. 24, 2044, Notice of Allowance Sep. 15, 2014.

K. Meyer et al., "Triboluminesszenzuntersuchungen an Alkalihalogeniden und Rohrzucker", Physica Status Solidi (B), vol. 8., No. 2, Jan. 1, 1965, pp. 441-456.

Stefan Kneip, "A Stroke of X-Ray", Nature, May 26, 2011, pp. 455-456.

Hird J. et al., "A Triboelectric X-ray Source", Applied Physics Letters, American Institute of Physics, US, vol. 98, No. 13, Mar. 28, 2011, pp. 133501-133501.

Extended European Search Report on related European Patent Application No. 13767356.2 from the European Patent Office (EPO) dated Aug. 4, 2015.

* cited by examiner

X-RAY GENERATOR DEVICE

CROSS-REFERENCE TO RELATED APPLICATION

The present application is a continuation of U.S. patent application Ser. No. 13/431,473, filed Mar. 27, 2012, the disclosure of which is incorporated by reference herein.

BACKGROUND OF THE INVENTION

The present invention relates generally to generation of high-energy radiation, and more particularly to generation of high energy radiation by mechanical motion.

X-rays are used in a variety of ways. X-rays may be used for medical or other imaging applications, crystallography related applications including material analysis, or in other applications.

X-rays are generally generated by electron braking (bremmstrahlung) or inner shell electron emission within a material. Historically, other than through natural phenomena, x-rays generally have been generated by accelerating electrons into a material, such as a metal, with a small proportion of the electrons causing x-rays through bremmstrahlung or knocking electrons present in the material out of inner orbitals, for example K-shell orbitals, with x-rays being generated as electrons in higher energy orbitals transition to the lower energy orbitals. Acceleration of the electrons to generate a useful quantity of x-rays, however, generally requires expenditure of significant power, particularly when considering the small percentage of such electrons which actually result in x-ray emissions.

X-rays may also be generated by changes in mechanical contact between materials in a controlled environment, for example through the unpeeling of pressure sensitive adhesive tape or mechanical contact of some materials in an evacuated chamber. However, utilization of such methods to provide a sufficient intensity of x-rays to be commercially useful, and doing so outside of a laboratory environment, may be difficult.

BRIEF SUMMARY OF THE INVENTION

In one aspect the invention provides a device, comprising: a chamber at least partially evacuated of gases; an arm with at least one end within the chamber, at least a portion of the arm within the chamber forming a striker, the arm being associated with a magnet; a strike plate within the chamber and positioned to be struck by the striker, the strike plate being of a material, on at least a portion to be struck by the striker, that charges negative relative to a striking portion of the striker; and a magnetic field generator outside the chamber, the magnetic field generator being capable of generating a magnetic field to cause the striker to strike the strike plate.

One aspect of the invention provides a device, comprising: a chamber at least partially evacuated of gases; a spring leaf with at least one end within the chamber, at least a portion of the spring leaf within the chamber forming a striker, the spring leaf coupled to a fixed magnet; a strike plate within the chamber and positioned to be struck by the striker; a magnet outside the chamber, the magnet coupled to a spindle of a motor; and control circuitry to drive the motor such that rotation of the spindle causes rotation of poles of the magnet at a frequency about a resonant frequency of the spring leaf.

One aspect of the invention provides a method of generating high energy radiation by a magnetically coupled resonant spring system to drive two surfaces in and out of contact.

One aspect of the invention provides a device for generating x-rays though repeated mechanical contact of materials, at a rate greater than tens of hertz (Hz), in an evacuated chamber. In some embodiments the rate is greater than 500 Hz. In some embodiments the rate is greater than 1000 Hz. In some embodiments the evacuated chamber includes a getter material.

Another aspect of the invention provides a magnetically actuated lever arm positioned to repeatedly strike a membrane so as to generate x-rays, with the lever arm and the membrane in an evacuated chamber. In some embodiments the magnetically actuated lever arm is in the form of a leaf spring. In some embodiments the lever arm is part of a spring system. In some embodiments the spring system is driven about a resonant frequency of the spring system. In some embodiments the magnetically actuated lever arm is drivable by a magnetic field generator. In some embodiments the magnetic field generator is an electromagnet. In some embodiments the magnetic field generator is a rotatable magnetic field generator. In some embodiments the rotatable magnetic field generator is provided by way of at least one rotating magnet driven by a motor, which in some embodiments is an electric motor and which in some embodiments is a brushless direct current motor, and which in some embodiments is an induction motor.

Another aspect of the invention provides for repetitively varying a magnetic field to cause a striker to strike a strike plate in an evacuated chamber. In some embodiments the striker is on a lever arm. In some embodiments the strike plate is a membrane. In some embodiments the chamber includes a getter material. In some embodiments the magnetic field is varied by modifying currents in multiple coils about the chamber. In some embodiments the magnetic field is varied by rotating at least one magnet using a motor. In some embodiments the motor is supplied power from a battery.

Another aspect of the invention provides a device, comprising: a chamber at least partially evacuated of gases; a lever arm with at least one end within the chamber, at least a portion of the lever arm within the chamber forming a striker, the lever arm being associated with a magnet; a strike plate within the chamber and positioned to be struck by the striker; and a magnetic field generator outside the chamber, the magnetic field generator being capable of generating a magnetic field to cause the striker to strike the strike plate.

These and other aspects of the invention are more fully comprehended upon review of this disclosure.

DETAILED DESCRIPTION

Figure 1:
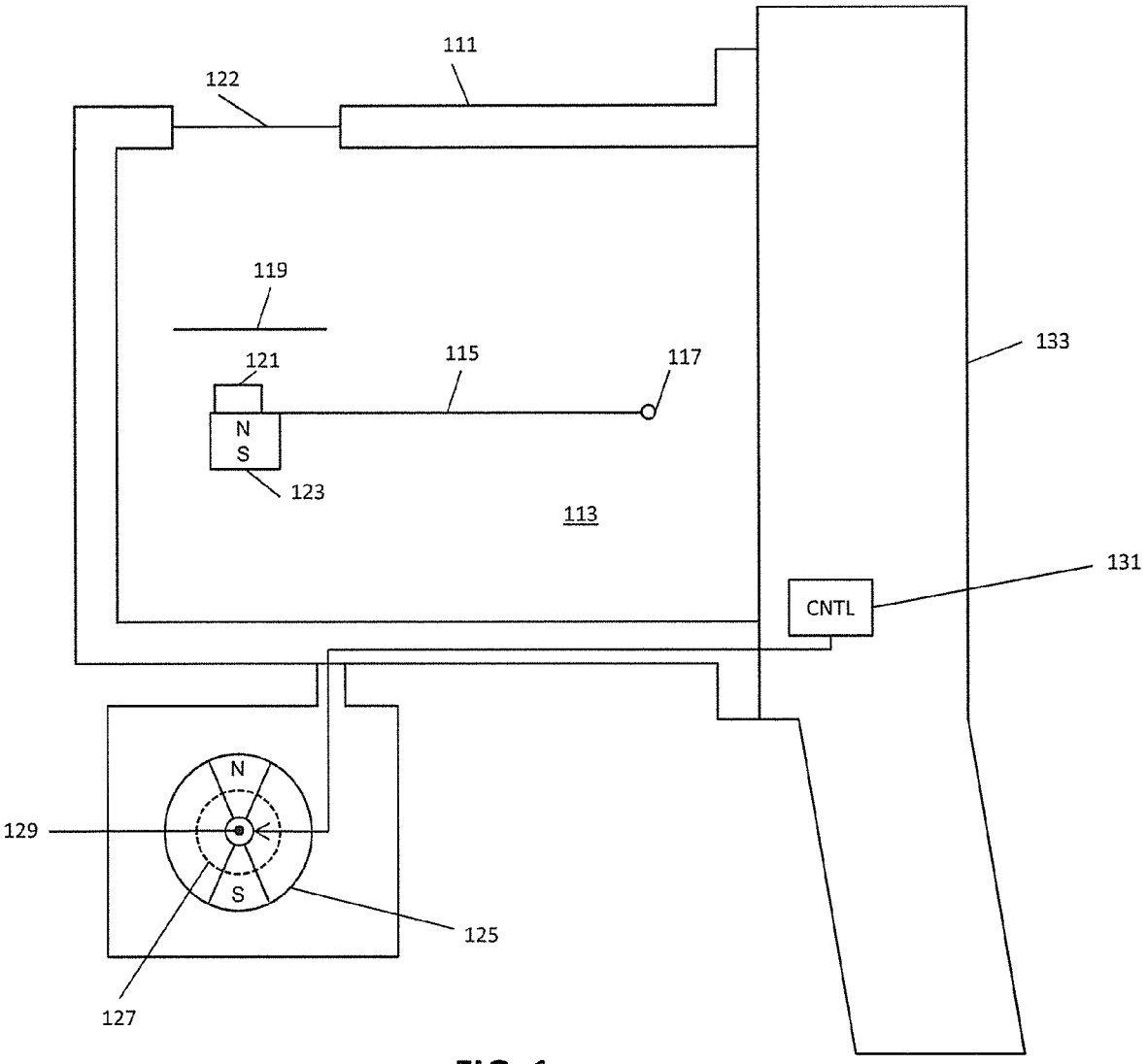
FIG. 1 is a semi-block diagram of a high energy radiation generator device in accordance with aspects of the invention.

FIG. 1 is a semi-block diagram of a high energy radiation generator in accordance with aspects of the invention. In some embodiments the generator may be used as an x-ray source. In some embodiments the x-ray source may be used in conjunction with an x-ray detector, for example to identify chemical composition of materials from their x-ray fluorescence (XRF). In some embodiments the generator is part of an XRF device, for example a handheld XRF device, and in some embodiments a housing of the device may also include an x-ray detector or components of an x-ray detector.

As shown in FIG. 1, an arm 115 is mounted at, and extends from, a base 117. The arm in most embodiments is flexible, forming a spring leaf. In some embodiments the base may be pivotable and in some embodiments the arm may also be substantially inflexible. The arm is positioned such that a portion of the arm may strike a strike plate 119. Preferably at least one of the striking portion of the arm and struck portion of the strike plate is insulated from ground. In addition or instead, preferably material of the strike plate, or of the struck portion of the strike plate, is of a material that charges negative relative to material of the arm, or of the striking portion of the arm. In some embodiments the arm, or the striking portion of the arm, is metal, or includes metal alloys or elements. In some embodiments the strike plate is an electrically insulating material. In some embodiments the strike plate is formed of a membrane, for example formed of a polymeric material, which may be stretched between two posts of the generator. In some embodiments a striker 121 is coupled to the arm, such that the striker strikes the strike plate, while in other embodiments the striker may be part of the arm.

As illustrated in FIG. 1, the arm and the strike plate are within a housing 111 defining a chamber 113, although in some embodiments only portions of the lever arm and strike plate that contact one another are within the chamber. The chamber is under a controlled fluid pressure, with in many embodiments the pressure being less than one atmosphere and in some embodiments the pressure being at or about 100 mTorr, in some embodiments less than 100 mTorr, and in some embodiments less than 50 mTorr. In various embodiments the housing includes one or more ports to allow for control of presence of gasses in the chamber. In some embodiments a getter material is instead or in addition provided within the chamber. The getter material, for example, may act as a getter pump, which may provide a low pressure atmosphere or further sustain the low pressure atmosphere in view of slight leakage into the chamber or in view of outgassing of materials within the chamber.

The arm also includes a magnet 123 approximate a free end of the arm. The magnet is within a magnetic field produced by a driving magnet 125. The driving magnet is rotatably mounted on a shaft or spindle, driven by a motor 127. In most embodiments the driving magnet and/or the motor are outside of the chamber. Provision of the driving magnet and/or motor outside the chamber may be beneficial in, for example, reducing outgassing effects within the chamber as well as allowing for adjustment or replacement of the driving magnet and/or motor without affecting pressure within the chamber. Control circuitry 131 controls operation of the motor, and the control circuitry may, for example, be mounted in a handgrip 133 to which the housing forming the chamber may be attached.

In operation, the motor rotates the driving magnet, causing the north pole and the south pole of the driving magnet to successively approach and recede from a position nearest to the magnet of the lever arm. The movement of the driving magnet results in successive reversal of the magnetic field in the vicinity of the magnet of the arm, forcing the end of the arm successively to strike and withdraw from the membrane. Each successive strike of the membrane causes emissions of x-rays, some of which exit the housing through a window 122 in the housing. As illustrated in the embodiment of FIG. 1, the window is located in a portion of housing approximate the strike plate, on a side of the strike plate opposite the striker. In some embodiments the window may include a collimator, or the collimator may be within the housing behind the window.

In some embodiments, the arm is in the form of a leaf spring, normally biased away from the strike plate for example, and the leaf spring may have only a single leaf. In such embodiments, flexibility of the leaf spring may allow the leaf spring to be fixedly mounted to a fixed base.

In some embodiments an electromagnet is used in place of the motor and driving magnet, with the electromagnet also outside of the evacuated chamber in most embodiments. Provision of pulses of direct current, or alternatively an alternating current, to the electromagnet repetitively drives the striker of the leaf spring against and away from the strike plate.

In some embodiments the spring is driven about a resonant frequency of the spring. Driving the spring about its resonant frequency may be beneficial in that doing so generally allows for maximum displacement of the striker from the strike plate, allowing for greater potential between the striker and strike plate, with generally reduced driving power.

In many embodiments the spring is a cantilever. For instances in which the cantilever has a rectangular cross-section, the resonant frequency of such a spring may be considered as proportional to the square root of the elasticity of the material (E) times the width of cantilever (w), divided by the mass of the cantilever (m), all of which is multiplied by the ratio of the height of the cantilever (h) cubed divided by the length of the cantilever (L) cubed, or in equation form $$\omega_0 \propto \sqrt{\left(\frac{Ewh^3}{mL^3}\right)}$$

Perhaps more accurately, the resonant frequency of such a spring may instead be considered as $$\omega_0 \propto \sqrt{\left(\frac{Ewh^2}{(\frac{\rho}{2}+m)L^2}\right)}$$

with ρ equal to the density of the spring material.

Figure 2:
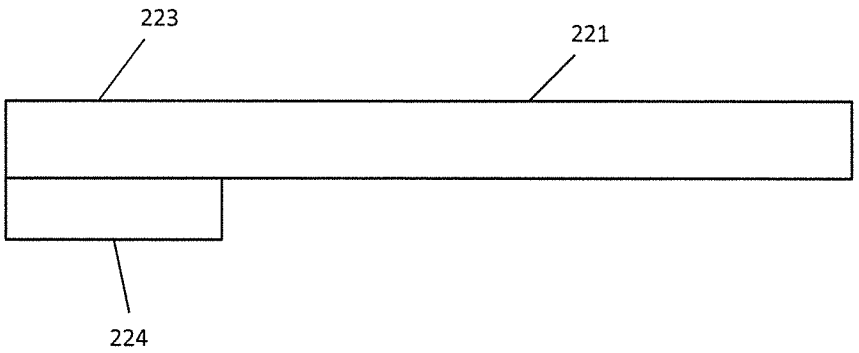
FIG. 2 is a side view of a lever arm with striker and magnet in accordance with aspects of the invention.

FIG. 2 is a side view of an arm 221 with a magnet 224 in accordance with aspects of the invention. The magnet is on one side about an end of the arm, with the end generally the free end of the arm. The opposing side of the free end serves as a striker 223 for striking a strike plate, such as that provided by the membrane of the device of FIG. 1. In some embodiments, as for example discussed with respect to FIG. 1, the striker is separately affixed to the arm.

The arm is, in some embodiments, formed of metal, for example a sheet of blue tempered stainless steel. In some embodiments the arm comprises a polymeric material including some metal elements or alloys or a combination of elements or alloys. In some embodiments, the arm is a polymeric material, with metal elements or compounds in the region of the striker.

Figure 3:
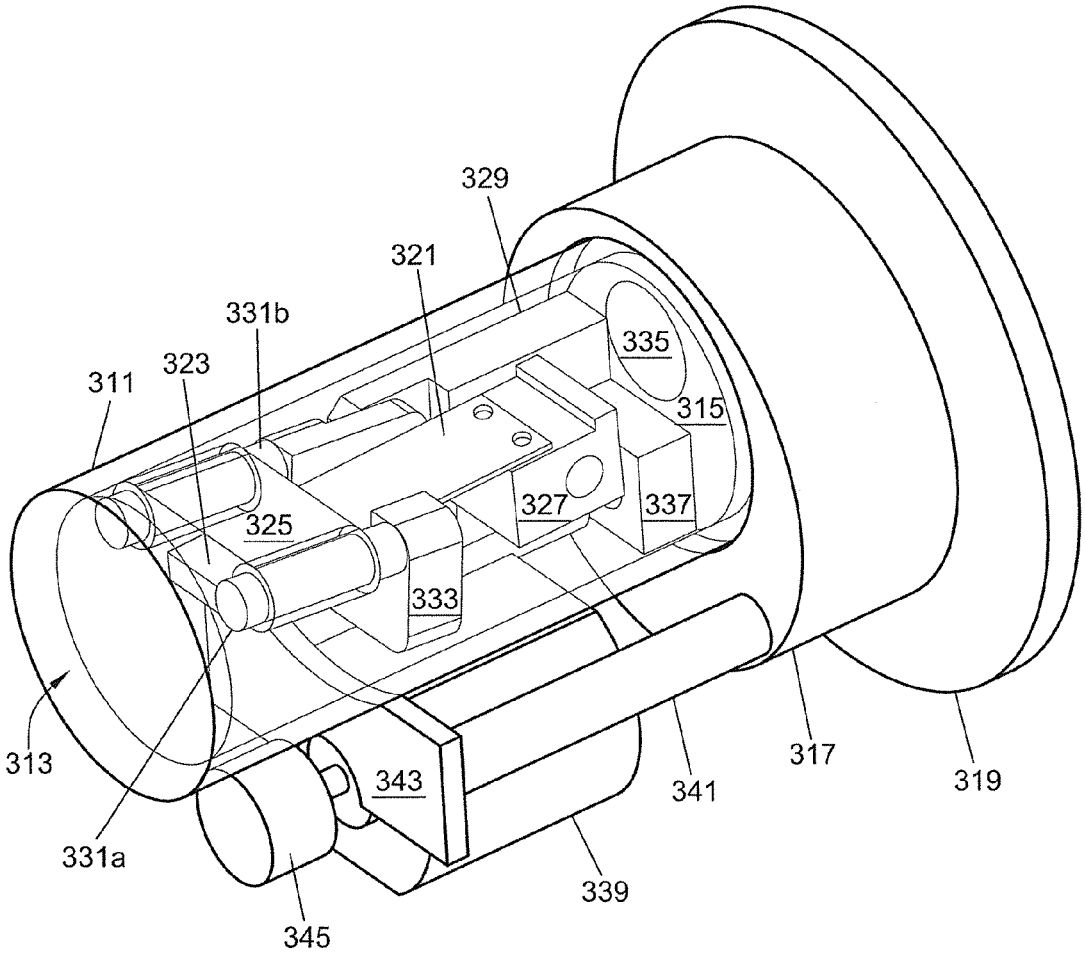
FIG. 3 is a perspective view of an x-ray generator device in accordance with aspects of the invention.

FIG. 3 illustrates a further device for generating x-rays in accordance with aspects of the invention. In the device of FIG. 3, a housing 311 forms a chamber 313. In some embodiments, and as illustrated in FIG. 3, the housing is generally tubular, with a circular top and an extending tubular sidewall. A cap 315 fits within the tubular sidewall opposite the circular top, so as to complete the chamber within the housing. The cap preferably tightly seals the chamber, for example through the use of mating threads and O-rings or the like, or through other means. In some embodiments, and as illustrated the cap includes a sealable port 335 for use in evacuating gasses from the chamber to provide a low pressure environment within the chamber. The port may be sealed by a cover or the like. In addition, a getter material may be used to provide maintenance of the low pressure environment in the chamber. For example, a block 337 of suitable and suitably treated metal may be affixed to the cap, with the block serving as a non-evaporable getter pump.

The housing is mounted to a base 317. The base, in the embodiment illustrated in FIG. 3, is generally cylindrical in form, with cylindrical cutout through the length thereof. The sidewall of the housing extends into the cutout of the base, and may be held in place through mating threads on the exterior of the sidewall and corresponding threads in the cutout or through clips or other means. In addition, an end of the base opposite the housing includes a flange 319, which may be useful in mounting the device to a grip, for example.

Within the housing, an arm 321 has a free end with a striker 323. The arm is positioned such that the striker is able, upon movement of the free end, to strike a strike plate formed by a membrane 325. Movement of the free end of the arm may be allowed by attaching a fixed end of the arm to a base 327, as shown in FIG. 3, with the arm of a sufficiently flexible material, by allowing the base to pivot, or by a combination of both.

The arm also includes a magnet or magnetic material about the free end, with the poles of the magnet orientated with respect to one another along, or substantially along, an axis of motion of the arm which allows the striker to strike the strike plate. Accordingly, the striker may be caused to repetitively strike the strike plate through the repetitive application, reversal, or rotation of a magnetic field about the arm.

In the embodiment of FIG. 3, a pod 339, located outside of the housing, contains a magnetic field generator, or a driver for causing a magnetic field generator about to the pod to vary a generated magnetic field. The magnetic field generator is, in some embodiments, an electromagnet, for example a coil which generates a magnetic field upon the application of current to the coil. Preferably control circuitry is supplied to provide for activation and deactivation of the coil at frequencies about a resonant frequency of the spring. In some embodiments the resonant frequency of the spring is between 20 Hz and 500 Hz. In some embodiments the control circuitry provides for activation and deactivation of the coil at frequencies about or greater than 1 kHz. In other embodiments, the magnetic field generator may be in the form of a motor coupled by a central shaft to a magnet with poles transverse to the shaft. Preferably, the control circuitry either operates the motor at speeds about the frequencies mentioned with respect to the coil, or at such speeds that gearing results in rotation of the shaft at such speeds. In various embodiments the pod may additionally include batteries to provide electrical energy to the electromagnet or motor.

In various embodiments the arm may be formed of a metal material, or polymeric material, with in some embodiments the arm including a metal or metal alloy, or including a metal or metal alloy on a contact surface of the striker. In some embodiments the striker may simply be a portion of one face of the lever arm, for example about its free end in some embodiments, but in various other embodiments the striker may be a coating on or other material coupled to or affixed to the arm. Similarly, the membrane may be formed of polymeric material, with in some embodiments the membrane including a metal or metal alloy.

In various embodiments a wire is used to discharge electric charge on the striker and/or strike plate approximate contact of the striker and strike plate. The wire may be fixed in position about the strike plate, for example across a width of the strike plate in the area struck by the striker, or through an aperture in the strike plate in that same area. A cavity or an aperture may extend into or through the arm about the striker. The cavity or aperture may also extend into or through the magnet. The cavity of aperture allows for entry or passage of the wire, for example appropriately shaped or bent, into or through a volume of the arm.

The wire may be tied to a ground or other generally constant voltage level, at least during operation. More commonly, however, the wire may have a first end tied to a first voltage level and a second end tied to another voltage level, allowing for generation of a current in the wire. In such embodiments the circuit including the wire may also include a resistance to reduce current, and therefore power, utilized by the circuit including the wire.

As illustrated in FIG. 3, the membrane is a polymeric band that stretches between two mounting posts 331*a,b*, although other structures may be used, and the membrane may for example be held between clamps. The mounting posts each extend from a U-support bracket 333 extending transverse to the arm, with the arm extending through or about a U-shaped concavity of the U-support bracket. In some embodiments the mounting posts are removably attached to the U-support bracket, for example by way of threads, allowing for replacement of the polymeric band. In other embodiments the mounting posts are fixedly attached to the U-support bracket in a more permanent manner, for example through press fitting.

The U-support bracket is coupled to a support arm 329. The support arm extends from the cap of the housing, generally about the sidewall of the housing. The U-support bracket in some embodiments is coupled to the support arm using screws or other relatively non-permanent attachment hardware, allowing, for example, for replacement of the polymeric band by replacing the U-support bracket, the mounting posts, and the polymeric band as a unit.

The base to which the arm is attached is also coupled to the support arm. The base may be coupled to the support arm by way of a rivet or other hardware allowing for rotation of the base, at least in embodiments in which a pivotable base is used to allow for motion of the arm. In embodiments in which the arm is, for example, in the form of a leaf spring, and the leaf spring itself provides sufficient flexibility in movement of the striker, the base may be a fixed base.

The pod 339 is coupled to the base 317 by way of extension posts 341 and a bracket 343, to which the pod is mounted. The extension posts extend from the base about the exterior of the sidewall of the housing, preferably a sufficient distance to place a magnetic field generator within or about the pod approximate the free end of the arm. In some embodiments the pod includes a motor to rotate a shaft coupled to a magnet 345 external to the pod, with the magnet having poles along an axis orthogonal to a direction of extension of the lever arm. In other embodiments the magnetic field generator may be within the pod, along with a motor or other driving element. In addition, the pod may additionally contain batteries or other energy sources to power the motor or other driving element.

Figure 4:
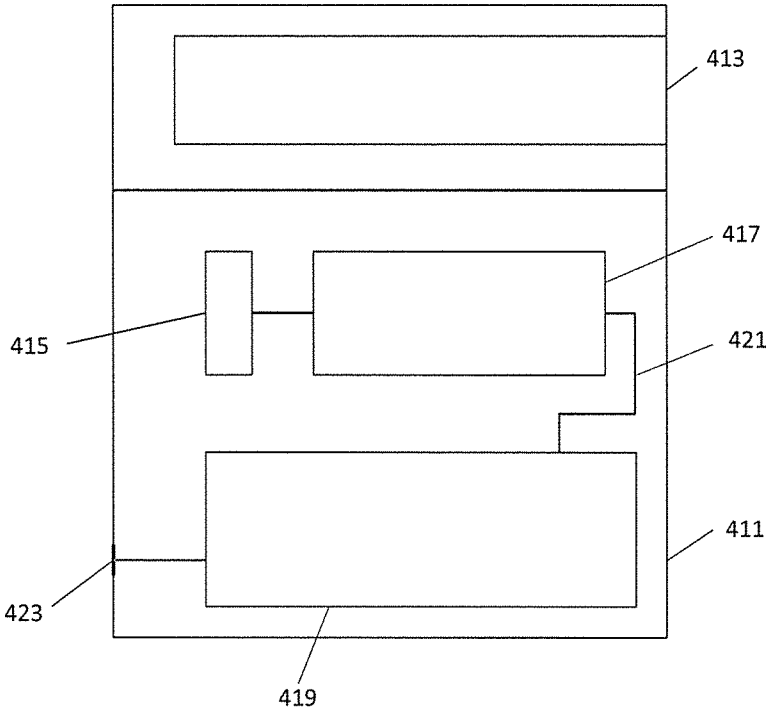
FIG. 4 is a front plan cutaway view of a further high energy radiation generator device in a hand-held form factor in accordance with aspects of the invention.

FIG. 4 is a cut away view of a further high energy radiation generation device in accordance with aspects of the invention. The device has a container 411 for containing various components of the device. In some embodiments the container is substantially in the shape of a parellepiped, and in various embodiments has a hand-held form factor.

A high energy generation module 413 is within an upper portion of the container. The high energy module is preferably generally sealed, with an access port in some embodiments to allow for control of the environment within the module, particularly fluid (gas) pressure as well as mix of gasses. In many embodiments the high energy component is in the form of a cartridge, for example replaceably mounted within the container. The high energy module includes, in various embodiments, a leaf spring and a strike plate, with the two relatively positioned such that a portion of the leaf spring may strike the strike plate. The leaf spring has an associated magnet, either coupled to or attached to the leaf spring or integrally part of the leaf spring material. The strike plate is for example of an electrically insulating material. Although not shown in FIG. 4, the high energy generation module and the container have corresponding windows to allow for generated radiation to exit the device.

In a lower portion of the container is a magnet 415 coupled to a shaft of a motor 417, with rotation of the shaft of the motor resulting in reversal of position of poles of the magnet. The magnet is substantially positioned below the magnet of the leaf spring. Accordingly, operation of the motor may result in driving the leaf spring towards and away from the strike plate, with appropriate orientation of poles of the magnet associated with the leaf spring.

The motor is connected by wiring 421 to an electronics package 419. The electronics package includes control circuitry and a battery pack. The battery pack provides power for the control circuitry and the motor, with the control circuitry controlling operation of the motor. In various embodiments the control circuitry controls operation of the motor such that the shaft of the motor rotates the magnet at a resonant frequency of the leaf spring of the high energy generation module. In some embodiments, and as illustrated in FIG. 4, a switch 423 is provided to provide a command to the control circuitry to command operation of or cease operation of the motor, thereby turning on or turning off the high energy generation device.

Figure 5:
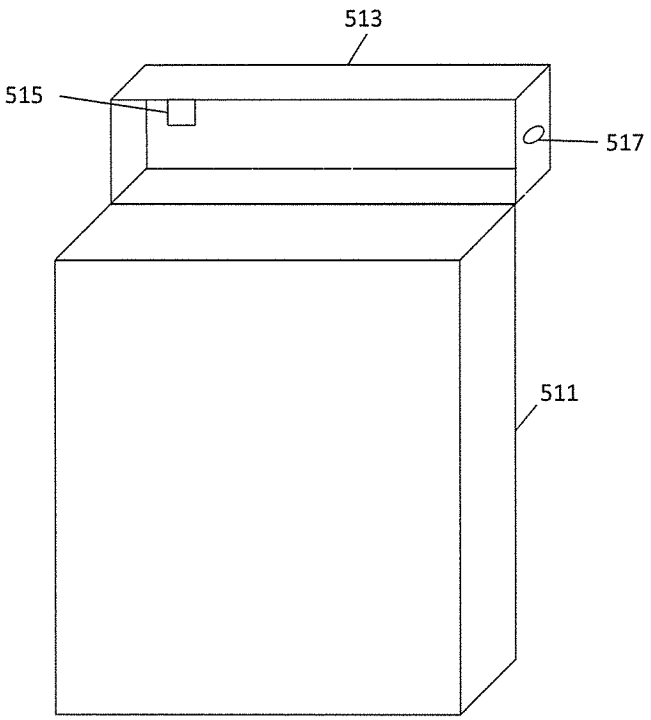
FIG. 5 is a perspective view of an embodiment of the container of the device of FIG. 4.

FIG. 5 is a perspective view of an embodiment of the container for the high energy radiation device of FIG. 4. The container is a casing in parallelpiped form, with an upper portion 513 coupled to a lower portion 511 by a hinge. As shown in FIG. 5, the upper portion is in an open position, allowing for access to an interior of the container.

The upper portion includes a window 515, shown on the top of the casing, and a port 517, along a side of the casing. The window and the port are positioned to match positions of a corresponding window and port in a high energy generation module, for example the high energy generation module as discussed with respect to FIG. 4, which may be replaceably mounted in the upper portion.

Figure 6:
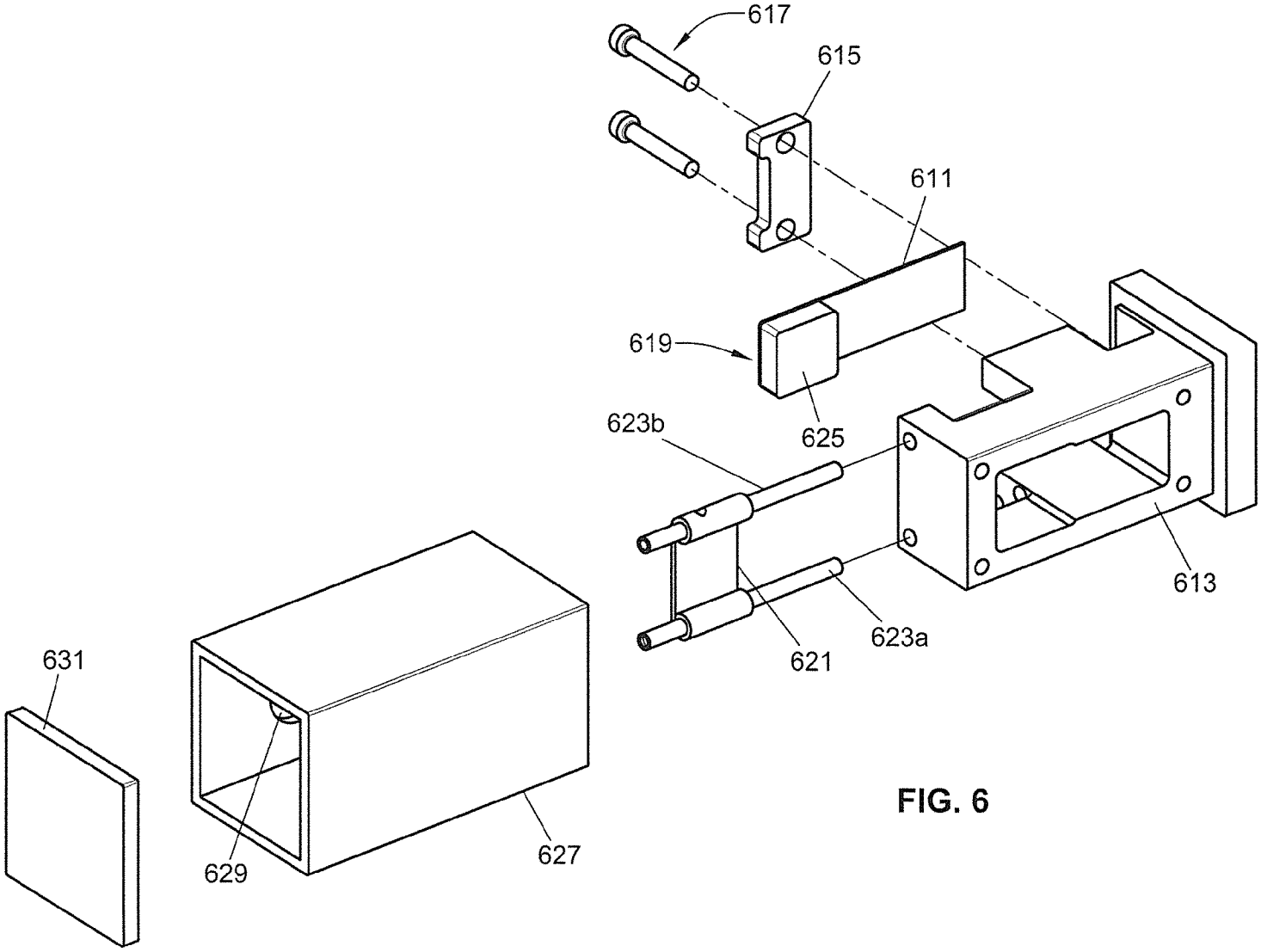
FIG. 6 is an exploded view of a replaceable high energy generation component for the device of FIG. 4.

FIG. 6 illustrates an exploded view of an embodiment of a high energy radiation module in accordance with aspects of the invention. The module includes a leaf spring 611. The leaf spring is mounted to a mount 613, for example by way of a mounting plate 615 and screws 617 passing through the mounting plate and into the mount.

The leaf spring provides a striker 619 about a forward free end of the leaf spring. Flexing of the leaf spring allow the striker to strike a membrane 621 stretched between two mounting pins 623*a,b*, with the mounting pins also fixed to the mount. The membrane in many embodiments is of a non-conductive or electrically insulating material, and in some embodiment is a polymeric material. A magnet 625 is coupled to the leaf spring on a side opposite the striker, allowing for use of magnetic forces to deflect the leaf spring and cause the striker to strike and withdraw from the membrane.

In various embodiments the high energy radiation generator devices discussed herein provide for high energy radiation generation in a pulsed manner, with the pulses of high energy radiation occurring periodically at the same frequency as the frequency of oscillation of the striker, or, more particularly, frequency at which the striker loses contact with the strike plate. Accordingly, frequency of the pulses of high energy radiation may be provided at desired frequencies by control of driving frequency of the spring, to which the strike plate is attached or is part of, of the devices.

Figure 7:
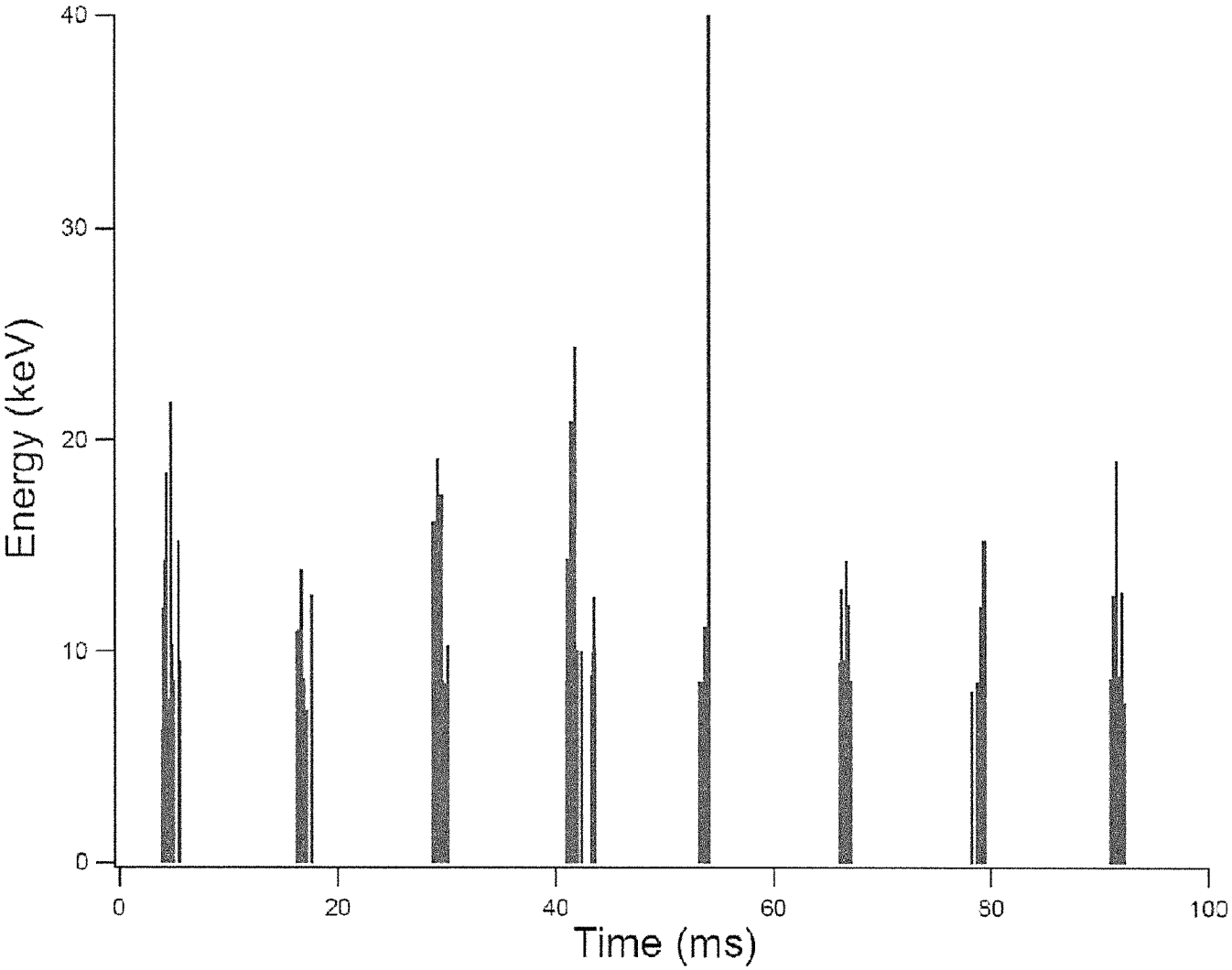
FIG. 7 is a chart of x-ray energy versus time for x-rays produced by a high energy radiation generator in accordance with aspects of the invention.

For example, FIG. 7 shows generated x-ray energy over time for a generator device operating at a striker/strike plate contacting rate of approximately 80 Hz, with a silicon PIN diode used as an x-ray detector. As may be seen in FIG. 7, pulses of x-rays are generated approximately every 12-13 milliseconds, with the pulses occurring over a period of a few milliseconds. In some embodiments frequency of operation is greater than that shown in FIG. 7, for example 500 HZ. In some embodiments, the duration of the x-ray pulses can be a few nanoseconds. Accordingly, in some embodiments high energy radiation generator devices in accordance with aspects of the invention provide a source of synchronous nanosecond x-ray pulses. Further, in addition, in some embodiments the high energy radiation generator devices produce x-rays in excess of 10e8 x-rays/sec, with in some embodiments the devices producing x-rays at approximately 10e9 x-rays/sec.

Pulsed x-ray generation may be beneficial in a variety of applications. For example, use of the high energy radiation generator devices discussed herein providing pulsed x-ray generation may be useful in medical imaging apparatus. In such apparatus, the x-ray pulses allow for capture of a sequence of images over time, with each of the images captured over nanosecond or millisecond x-ray exposure periods.

In addition, generally pulsed radio frequency (RF) energy is also produced by the high energy radiation generator devices, with the RF energy pulses correlated to, for example in phase with, the x-ray pulses. In such embodiments, detector devices, for example imaging apparatus, may utilize reception of the RF pulses as a source of timing for use in image capture. In another embodiment, the RF pulses can be used to synchronize the detection of x-ray fluorescence from an irradiated sample.

A casing 627 is affixed to a base of the mount. The casing, together with a cap 631 covering a top of the casing and the base of the mount, encloses the leaf spring and membrane. In addition, although not visible in FIG. 6, the base of the mount includes a sealable access port, allowing for control of the environment in the chamber formed by the casing, top, and base.

Although the invention has been discussed with respect to various embodiments, it should be recognized that the invention comprises the novel and non-obvious claims supported by this disclosure.

What is claimed is:

1. A device for generating x-rays, comprising:

a chamber at least partially evacuated of gases;

a spring leaf with at least one end within the chamber, at least a portion of the spring leaf within the chamber forming a metal striker, the spring leaf coupled to a fixed magnet;

a strike plate within the chamber and positioned to be struck by the metal striker, the strike plate comprising an electrically insulating material, on at least a portion to be struck by the metal striker, that charges negative relative to a metal striking portion of the metal striker;

a magnet outside the chamber, the magnet coupled to a spindle of a motor; and control circuitry to drive the motor such that rotation of the spindle causes rotation of poles of the magnet at a frequency about a resonant frequency of the spring leaf.

2. The device of claim 1, wherein at least one of the striking portion of the striker and the portion of the strike plate to be struck by the striker is insulated from ground.

3. The device of claim 1, wherein the strike plate comprises a membrane.

4. The device of claim 3, wherein the membrane is part of a polymeric band.

5. The device of claim 1, wherein a pressure within the chamber is less than 50 mTorr.

6. The device of claim 1, wherein a pressure within the chamber is less than 100 mTorr.

7. The device of claim 1, further comprising a getter material within the chamber.

8. The device of claim 1, wherein the chamber includes a sealable orifice.

9. The device of claim 1, wherein the striker and the strike plate are removable from the chamber.

* * * * *